US005701761A

United States Patent [19]

Prevost et al.

[11] Patent Number: 5,701,761

[45] Date of Patent: Dec. 30, 1997

[54] METHOD AND INSTALLATION FOR THE LIQUEFACTION OF NATURAL GAS

[75] Inventors: Isabelle Prevost, Conflans Sainte Honorine; Alexandre Rojey, Rueil Malmaison, both of France

[73] Assignee: Institut Francais du Petrole, Rueil Malmaison, France

[21] Appl. No.: 652,527

[22] PCT Filed: Oct. 3, 1995

[86] PCT No.: PCT/FR95/01281

§ 371 Date: Jun. 3, 1996

§ 102(e) Date: Jun. 3, 1996

[87] PCT Pub. No.: WO96/11370

PCT Pub. Date: Apr. 18, 1996

[30] Foreign Application Priority Data

Oct. 5, 1994 [FR] France ..... 94 12046

[51] Int. Cl.[6] ..... F25J 3/00

[52] U.S. Cl. ..... 62/613; 62/619; 62/623

[58] Field of Search ..... 62/612, 613, 619, 62/623

[56] References Cited

U.S. PATENT DOCUMENTS 3,645,106 2/1972 Gaumer, Jr. et al. ..... 62/612
3,932,154 1/1976 Coers et al. ..... 62/612
4,094,655 6/1978 Krieger ..... 62/612
4,141,707 2/1979 Springmann ..... 62/612

FOREIGN PATENT DOCUMENTS 0117793 2/1984 France .
2049181 4/1972 Germany .

*Primary Examiner*—Ronald C. Capossela
*Attorney, Agent, or Firm*—Antonelli, Terry, Stout & Kraus, LLP.

[57] ABSTRACT

A pressurized natural gas is liquefied through at least one cooling cycle, in which a mixture of cooling fluids is used, comprising at least the following steps:

a) at least some of the said cooling mixture is condensed by compression and cooling, for example, using an external cooling fluid to obtain at least one vapor fraction and one liquid fraction, b) at least some of each of the vapor and liquid fractions is expanded separately to obtain a light fluid M1 comprising mostly a vapor phase and a heavy fluid M2 comprising mostly a liquid phase, c) the fluids M1 and M2 are at least partially mixed to obtain a low-temperature mixture, and d) the natural gas is liquified and undercooled under pressure by a process of heat exchange with the low-temperature mixture produced during step c).

13 Claims, 7 Drawing Sheets

METHOD AND INSTALLATION FOR THE LIQUEFACTION OF NATURAL GAS

BACKGROUND OF THE INVENTION

Natural gas liquefaction is an important industrial process enabling natural gas to be transported over long distances by methane tanker or stored in liquid form.

With currently used methods, a "natural gas" is liquefied by passing this natural gas through exchangers and cooling it by means of an external cooling cycle. Patents U.S. Pat. Nos. 3,735,600 and 3,433,026 describe liquefaction methods during which the gas is fed through one or several heat exchangers in order to produce liquefaction. The terms "natural gas" are used here to denote a mixture formed mostly of methane but possibly also containing other hydrocarbons and nitrogen, irrespective of the form in which it occurs (gaseous, liquid or di-phase). Natural gas mostly starts off in gaseous form and its pressure and temperature values during the liquefaction process are such that it may exist in different forms, with a liquid and gaseous phase occurring together at a given moment, for example.

An external cooling cycle is carried out as part of such methods, using a mixture of fluids as a cooling fluid. On evaporation, such a mixture is likely to cool and liquefy the pressurised natural gas. After evaporation, the mixture is compressed and condensed by a process of heat exchange with an ambient medium such as water or air.

In addition, in most of the processes that make use of a cooling mixture, the vapour fraction leaving the separator is liquefied by incorporating a cascade effect, whereby the increasingly lighter liquid fractions produced by each of the steps carried out to partially condense the cooling mixture are used to cool the natural gas and provide the cooling means required during the successive steps of condensing the vapour fraction.

Such methods are complex and require large exchange surfaces. They also require high compression capabilities and hence high capital investment.

The prior art also describes methods that operate by compressing and expanding a permanent gas such as nitrogen. These methods have the particular advantage of being simple in design. However, their performance is limited and as a result they are not especially suitable for natural gas liquefaction units on an industrial scale.

SUMMARY OF THE INVENTION

It has been discovered, and this is one of the objectives of the present invention, that it is possible to simplify the design of a liquefaction process, particularly one used to liquefy a natural gas, by using a cooling mixture without fully condensing it during the cycle and by substituting for the final step when the mixture is cooled a process of expanding the vapour phase produced from a first stage of condensing the mixture and of mixing it with an expanded liquid fraction to obtain a cooling mixture that can be used to liquefy the natural gas, by contact and heat exchange, for example.

By mixing the expanded liquid fraction with the expanded vapour fraction, the temperature at which the liquid fraction starts to evaporate at the low pressure level of the cycle can be lowered.

Unlike the prior art, the vapour fraction is not fully condensed but only partially condensed so that, at the lowest temperature of the cycle, it assumes the form of a mixture comprising a vapour fraction and a liquid fraction in variable proportions.

The process can be optimised by expanding the vapour phase through a turbine, recuperating the mechanical expansion power.

The invention relates to a method for liquefying a pressurised natural gas consisting of a cooling cycle using a mixture of cooling fluids, during which the following steps are carried out:

a) the said cooling mixture is at least partially condensed by compression and cooling using an external cooling fluid, for example, to obtain a vapour fraction and a liquid fraction, b) at least some of each of the said vapour and liquid fractions is expanded separately to obtain respectively a light fluid M1 consisting mostly of a vapour phase and a heavy fluid M2 consisting mostly of a liquid phase, c) the fluids M1 and M2 are mixed to obtain a low-temperature mixture, the mixture being formed before being passed through a process of heat exchange with the natural gas, and d) the pressurised natural gas is liquefied and undercooled by means of a process of heat exchange with the low-temperature mixture obtained during step c).

Advantageously, the vapour fraction may be expanded during step b) using a turbine and at least some of the mechanical energy can thus be recuperated.

The cooling mixture resulting from the process of heat exchange with the natural gas during step d) can be recycled to step a) during which the cooling mixture is compressed.

In accordance with one embodiment, at least one additional stage of cooling the mixture M2 is carried out before it is mixed with mixture M1.

The mixture M1 produced by expanding the vapour fraction resulting from the partial condensation of the cooling mixture is, for example, put through a process of heat exchange with the natural gas before being mixed with the fraction produced by expansion of the under-cooled liquid fraction resulting from partial condensation of the cooling mixture.

The cooling mixture may also be compressed in at least two steps between which a heat exchange cooling process is carried out, using an available external cooling fluid, water or air, for example.

It is to advantage to carry out at least one additional stage of cooling the cooling mixture and/or a liquid fraction and/or a vapour fraction resulting from the partial condensation of the mixture at the end of a cooling step, for which an external cooling fluid can be used, for example.

In this case, the liquid fraction produced from the partial condensation of the mixture is undercooled, for example, before being expanded by a process of heat exchange with the low-temperature mixture produced when the expanded fractions are mixed.

It may also be undercooled, expanded and mixed with the expanded fraction from the recycled fraction and used for heat exchange with the mixture to provide the capacity for an additional stage to cool the mixture resulting from the compression step and for the first stage of cooling for the natural gas.

The liquid fraction is undercooled to a temperature preferably below its evaporation temperature at the low pressure end of the cycle, for example.

Another approach is to cool, expand and mix the liquid fraction at different temperature levels corresponding to successive stages of heat exchange with the cooled natural gas.

In accordance with another way of implementing the method of the invention, the liquid fraction is undercooled, expanded and evaporated in order to provide the additional stage of cooling for the vapour fraction of the mixture produced at the compression and cooling stage using the available external cooling fluid, water or air, and a first stage of cooling for the pressurised natural gas, the expanded fraction from the recycled vapour fraction being compressed to an intermediate pressure level between the low pressure and high pressure of the cycle, for example, and mixed with the fraction produced during evaporation of the liquid fraction, this fraction being compressed beforehand to the said intermediate pressure level and the resulting mixture being compressed to the high pressure level of the cycle.

It is also possible to carry out a stage of additional cooling for at least some of the mixture produced by the partial condensation step and a first cooling step for the pressurised natural gas by incorporating a first cooling cycle using a cooling mixture, for example.

An additional stage can also be incorporated to cool the natural gas.

The vapour fraction can be put through at least two successive stages of partial condensation by cooling under pressure, the vapour fraction produced by each of these stages being separated and delivered to the subsequent stage, the vapour fraction from the final stage of partial condensation being at least partially expanded in a turbine, from which preferably at least some of the mechanical expansion energy is recuperated, for example, and then mixed with at least one of the previously expanded liquid fractions to produce a low-temperature mixture for heat exchange with the pressurised natural gas.

A fluid containing nitrogen and hydrocarbons with a number of carbon atoms ranging between 1 and 5 and preferably at least 10% of nitrogen by molar fraction can be used as the cooling mixture.

The cooling mixture used in the process is of a pressure of at least 200 kPa at compressor suction at step a).

The mixture M1 has at least 10% of liquid fraction by molar fraction, for example.

If the natural gas contains hydrocarbons other than methane, these hydrocarbons can be at least partially separated by condensation and/or distillation at the end of a first stage of cooling the pressurised natural gas, for example.

The same applies to a natural gas containing nitrogen and/or helium and these constituents can be at least partially separated by evaporation and/or distillation, the said evaporation causing an additional cooling of the cooled pressurised natural gas in liquid state.

The pressurised natural gas in the undercooled liquid state is at least partially expanded in a turbine, for example, to a pressure close to atmospheric pressure, producing the liquefied natural gas which is then exported.

The present invention also relates to an installation for cooling a fluid, in particular for liquefying a natural gas using a cooling mixture. It is characterised in that it comprises a first device for condensing the cooling mixture having at least one compressor $K_1$ and a condenser $C_1$, a device $S_1$ enabling the vapour fraction and the liquid fraction produced in the first condensing device to be separated, devices $T_1$ and $V_1$ allowing the separated liquid and vapour fractions to be expanded respectively, and at least one device $E_1$, such as an exchanger, in which the mixture of expanded liquid and vapour fractions is brought into thermal contact with the fluid to be cooled, such as the natural gas to be liquefied.

The device $T_1$ for expanding the vapour fraction and/or the expanding device $V_1$ is a turbine, so that at least some of the mechanical energy can be recovered.

In accordance with one operating method, the installation has an additional cooling device for the expanded liquid and/or vapour fractions, natural gas or cooling mixture.

The present invention therefore has a number of advantages over the methods commonly used in the prior art.

Partial condensation of the vapour fraction followed by a simple expansion is an easier and more economic method than that in which total cooling occurs, leading to total liquefaction of the vapour fraction.

The liquid and vapour fractions produced from a first stage of condensing the cooling mixture are expanded separately and mixed after expansion to produce a cooling mixture, which will be called the low-temperature cooling mixture, allowing the temperature at which the liquid fraction evaporates to be lowered.

In addition, the mechanical energy can be recovered by using a turbine.

BRIEF DESCRIPTION OF THE DRAWINGS

The present invention will be more readily understood and its advantages clearer from the description of several examples, not limitative, illustrated by the following drawings.

DETAILED DESCRIPTION OF THE PREFERRED EMBODIMENTS

Figure 1:
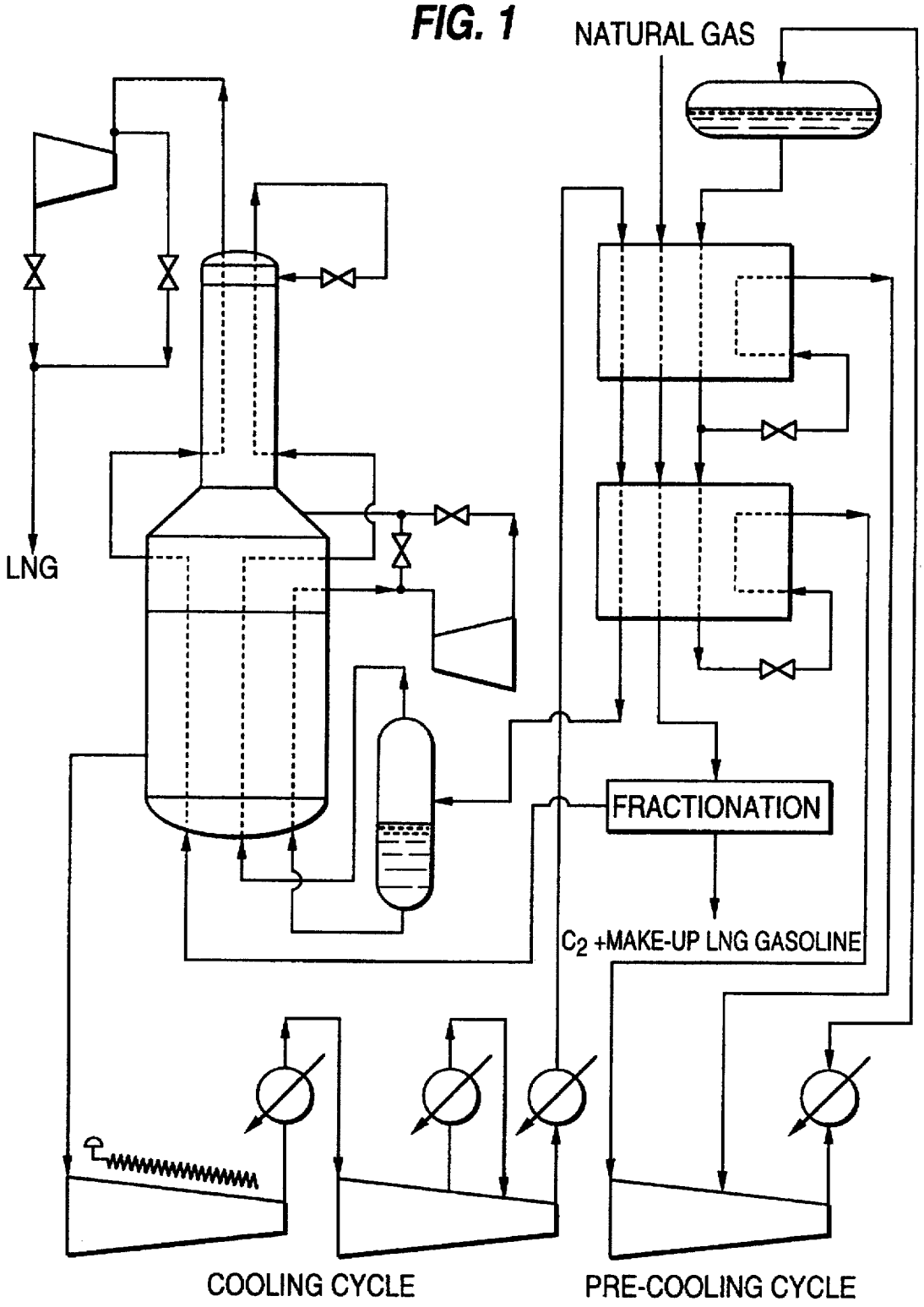
FIG. 1 diagrammatically illustrates an example of a cooling cycle such as that described in the prior art and incorporating a pre-cooling cycle.

The operating system used by the prior art to liquefy a natural gas is shown briefly in FIG. 1.

The liquefaction method includes a pre-cooling cycle, which enables the mixture used in the main cooling cycle to be condensed. A mixture of fluid is used in these two cycles which liquefies the pressurised natural gas on evaporation. After evaporation, the mixture is compressed and condensed by a process of heat exchange with the available ambient medium, be it water or air, and in most cases is recycled to a new liquefaction step.

The basic principle of the invention described below consists in cooling a fluid and in particular liquefying and undercooling a pressurised natural gas, for example, by cooling, by means of simple expansion, the vapour fraction produced during a first stage of condensing a cooling mixture and by mixing this partially condensed vapour fraction with a liquid fraction from the first condensation step, that has also been expanded, in order to obtain a low-temperature cooling mixture. This mixture causes a pressurised natural gas to liquefy and undercool during heat exchange, for example.

To provide a clearer understanding of the invention, the method described below is applied to liquefaction of a pressurised natural gas and refers to FIG. 2.

The pressurised natural gas to be liquefied is delivered by a pipe 1 into an exchanger $E_1$ and leaves this exchanger after liquefaction via a pipe 2.

The cooling mixture used during the method is first of all compressed in a compressor $K_1$, then fed via a pipe 3 to a condenser $C_1$ in which it is cooled and at least partially condensed, using an external cooling fluid such as water or air, for example. The di-phase mixture obtained after condensation is delivered via a pipe 4 into a separating chamber $S_1$. After separation, the vapour fraction is withdrawn through a pipe 5, for example, preferably located in the upper portion of the separator $S_1$ and fed into an expansion device, such as a turbine $T_1$. This expansion process causes the vapour fraction to cool to a temperature that is preferably essentially close to the temperature of the natural gas produced at the end, for example a temperature in the region of 115K. The expanded and cooled vapour fraction is in the form of a fluid M1, which is mainly made up of a vapour phase and is known as the light fluid, and this is fed through a pipe 9 to be mixed with the liquid fraction in the manner described below.

The mechanical expansion energy can be advantageously recovered and used, at least partially, to drive the compressor $K_1$.

The liquid fraction leaves the separator $S_1$ via a pipe 6 located in the lower portion of the separator $S_1$, for example, and linked to the exchanger $E_1$.

This liquid fraction is undercooled in the exchanger $E_1$, from which it is discharged via a pipe 7 before being expanded through an expansion valve $V_1$ and fed, after expansion, through a pipe 8. The expanded liquid fraction is in the form of a fluid M2 mainly made up of liquid phase or heavy fluid, which is discharged via a pipe 8.

The mixture M1 from pipe 9 is mixed with the mixture M2 from pipe 8 to form a low-temperature cooling mixture, the temperature of which is close to the final temperature of the liquefied natural gas produced. The temperature of this mixture is below the evaporation temperature of the liquid fraction M2 at identical pressure.

The low-temperature cooling mixture is delivered to the exchanger $E_1$, where it is used to cool the pressurised natural gas by a process of heat exchange and to undercool the liquid fraction before expansion.

Under these conditions, the cooling mixture remains, at least to a certain degree, in the vapour state throughout the cycle.

Figure 2:
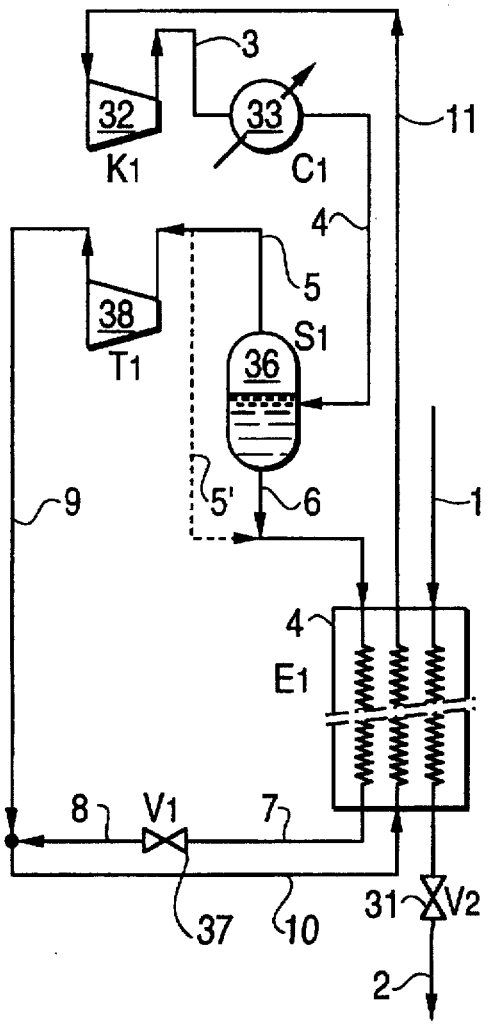
FIG. 2 is an operating diagram of the cycle used for liquefaction of a natural gas in accordance with the invention.

However, it is possible to condense some of the vapour fraction completely, for example by feeding a portion of the vapour fraction into the exchanger $E_1$ via pipe 5' as shown in FIG. 2. The proportion of vapour fraction fed into the exchanger may be controlled by a flow-control valve, for example.

During this liquefaction step, the liquid fraction within the mixture is evaporated and the resulting vapour mixture is recycled, for example, to the compressor $K_1$ via a pipe 11. The temperature of the natural gas and possibly any liquid or vapour fraction passing into the exchanger $E_1$ is cooled to a temperature essentially close to the temperature obtained by mixing the two fluids M1 and M2, for example.

The natural gas leaves the exchanger $E_1$ liquefied and under pressure via pipe 2, is expanded through an expansion valve $V_2$ to a pressure value essentially close to atmospheric pressure, for example, and then discharged to a storage and/or dispatch site, for example.

The mixture produced in the exchanger $E_1$ at the end of the heat exchange process is discharged and then recycled via a pipe 11 to the compressor $K_1$. It is compressed, for example, and then cooled by a process of heat exchange with the available external cooling fluid, water or air.

The low-temperature cooling mixture may also be used to undercool the liquid fraction leaving the separator chamber $S_1$, this latter being cooled in this case to a temperature below its evaporation temperature at a pressure value substantially equal to the low pressure level of the cycle. Under such conditions, its expansion through the expansion valve does not cause evaporation, which limits any mechanical phenomena that might be irreversible and improves performance of the cooling cycle.

This simplified version of how the method of the invention is implemented serves to illustrate some of its essential features, particularly the simplified design of the method, where the stage during which the vapour fraction is usually totally condensed in the prior art is replaced at least partly by a simple process of expansion in a turbine, carried out in vapour phase and producing no or a reduced amount of liquid phase.

A part of the vapour fraction may, however, be cooled and condensed, by the various known methods of the prior art, the liquid fraction thus obtained being expanded and mixed with fractions M1 and M2 to produce the low-temperature mixture which, by a process of heat exchange, enables the pressurised natural gas to be liquefied and under-cooled.

This offers various advantages and in particular the option of incorporating relatively high proportions of light constituents, such as nitrogen, in the cooling mixture. In effect, a fraction of the mixture remains constantly in vapour phase during the cycle, which makes it possible to operate at a relatively high pressure at compressor suction, preferably at a pressure level greater than or equal to 200 kPa, thereby reducing the size of the compressor and limiting the incidence of possible pressure losses.

In addition, since a significant proportion of the cooling power produced does not have to be used for liquifying the cooling mixture completely, performance and overall efficiency of the cycle are improved.

One of the ways of implementing the method of the invention is, therefore, to proceed with the following steps:

a) at least a part of the said cooling mixture is condense by compressing it and cooling it to obtain at least one vapour fraction and one liquid fraction, b) at least some of each of the said vapour and liquid fractions is expanded separately to obtain a light fluid M1 consisting mainly of a vapour phase and a heavy fluid M2 consisting mainly of liquid phase, c) at least some of the fluids M1 and M2 are mixed to obtain a low-temperature mixture, and d) the pressurised natural gas is liquefied and undercooled by a process of heat exchange with the low pressure mixture obtained during step c), the liquid fraction being evaporated during heat exchange and the vapour mixture produced by the heat exchange being recycled to the compressor, for example.

FIGS. 3 to 6 described below illustrate variants of the method of processing liquid and vapour fractions from the condenser $C_1$ as well as the natural gas incorporating, for example, an additional cooling step carried out on the mixture or one of the liquid or vapour frictions produced during a cooling step, for example, using an external fluid, or alternatively on the natural gas.

Figure 3:
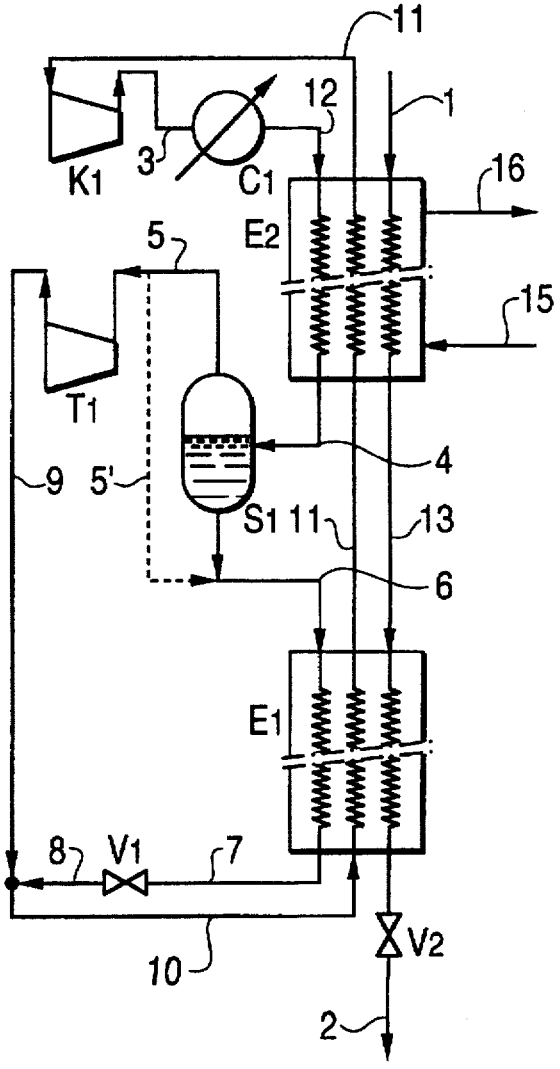
FIGS. 3, 4, 5 and 6 show variants incorporating an additional stage for cooling at least one of the fluids used in the method.

A preferred version of the method of the invention described with reference to FIG. 3 consists in continuing condensation of at least some of the cooling mixture to a temperature below the temperature of the external cooling fluid, air or water.

The cooling mixture is fed via a pipe 12 from the condenser $C_1$ to an additional exchanger $E_2$ where it is cooled. Once cooled, the cooling mixture is fed to the separator chamber $S_1$ via pipe 4 where it is then processed in the manner described above in relation to FIG. 2.

This additional cooling stage can be carried out at least partially by a process of heat exchange with the cooling mixture recycled from the exchanger $E_1$ fed in via pipe 11, which passes through the two exchangers $E_1$ and $E_2$, for example.

The additional exchanger $E_2$ allows the pressurised natural gas to be cooled during a first cooling step, for example, before it is fed via a pipe 13 to the exchanger $E_1$ where it undergoes a second cooling stage. The natural gas leaves the exchanger $E_1$ in pressurised liquid form and is then expanded through the valve $V_2$ and discharged.

In accordance with another embodiment of the invention, an additional cooling stage can be provided by heat exchange, using a cooling fluid entering the exchanger $E_2$ via a pipe 15 and leaving the exchanger via a pipe 16.

In particular, it is possible to provide the extra cooling capacity required by evaporating at least some of the liquid fraction of the cooling mixture.

Figure 4:
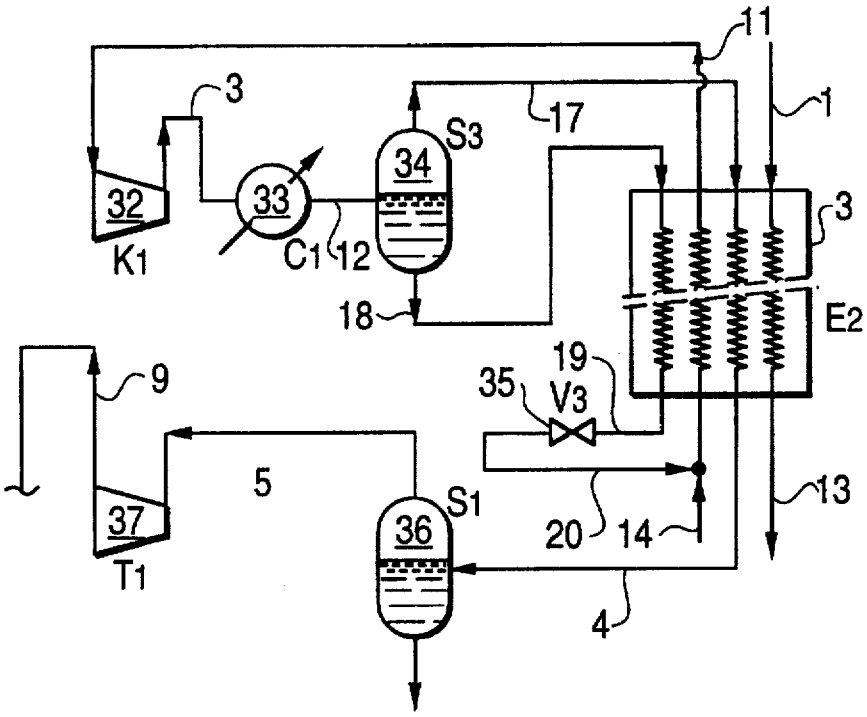

FIG. 4 shows a first embodiment in which the fluid passing through the exchanger $E_2$ is produced by evaporating at least one liquid fraction out from the cooling mixture.

The cooling mixture, which is at least partially condensed, is fed from the condenser $C_1$ to a separator chamber $S_3$. After separation, the vapour fraction is fed via a pipe 17 to the exchanger $E_2$, for example.

The liquid fraction is drawn off from the chamber $S_3$ via a pipe 18 and fed into the exchanger $E_2$, from which it is withdrawn, undercooled, via a pipe 19. This undercooled liquid fraction is expanded through an expansion valve $V_3$ and returned via a pipe 20 to the exchanger $E_2$. The expanded liquid fraction is mixed with the recycled vapour mixture from the exchanger $E_1$, this mixture then being recycled back to the exchanger $E_2$.

A mixture of this type can be used to undercool the liquid fraction, cool the vapour fraction entering the exchanger $E_2$ and possibly the natural gas during a first cooling stage. Having been pre-cooled in this way, the vapour fraction leaves the exchanger $E_2$ partially condensed via pipe 4 before being fed to the process steps described with reference to FIG. 2.

In this version of the method, the liquid fraction produced by partial condensation of the cooling mixture, obtained by cooling with the available external cooling medium, is undercooled, expanded and mixed with the expanded fraction from the recycled vapour fraction so as to provide, by heat exchange with the mixture thus obtained, the additional stage of cooling for the mixture produced at the compression stage, as well as a first stage of cooling for the pressurised natural gas.

Figure 5:
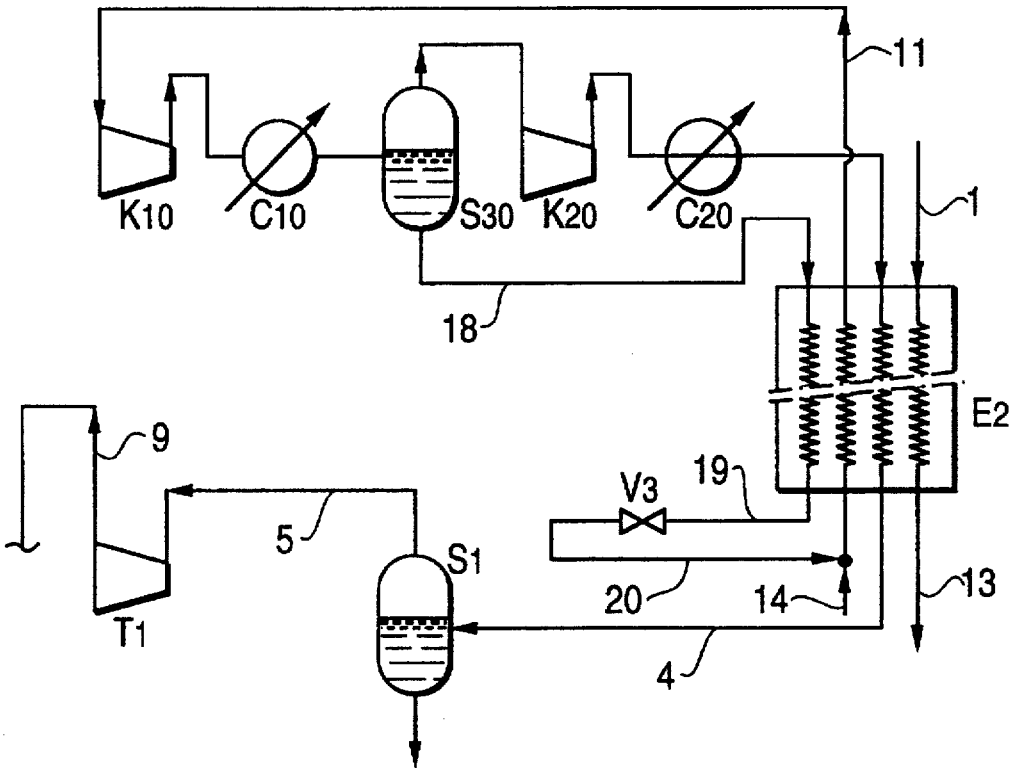

The liquid fraction of the cooling mixture which is evaporated to provide the additional cooling capacity required in the exchanger $E_2$ can also be separated at an intermediate pressure level as illustrated in the diagram of FIG. 5.

In this case, the cooling mixture is compressed to an intermediate pressure level during a first compression stage and then cooled by an available cooling fluid, water or air, in the exchanger $C_{10}$ and partially condensed. The liquid phase obtained is separated in the separator chamber $S_{30}$ and then fed to the exchanger $E_2$ where it is undercooled. From there it is fed via pipe 19 to the expansion valve $V_3$ and then evaporated in the exchanger $E_2$, from which it is discharged via pipe 11 and recycled to the compressor $K_{10}$.

The vapour phase leaving the separator $S_{30}$ is put through an additional compression step in the compressor $K_{20}$ and then cooled in the exchanger $C_{20}$. The resulting liquid-vapour mixture is then fed into the exchanger $E_2$. The liquid and vapour fractions may be delivered simultaneously, the flow being effected by gravity, for example, or separately with the liquid fraction being pumped, for example. Partial condensation of the mixture is continued in the exchanger $E_2$ and the liquid and vapour phases thus obtained are fed via pipe 4 to the separator chamber $S_1$ where they are separated. The two fractions thus obtained are fed to the process steps described with reference to FIG. 2.

Another possibility is to avoid mixing the undercooled and expanded liquid fraction from the condenser with the expanded fraction recycled from the vapour fraction.

Another approach is to carry out the pre-cooling step or additional cooling step using an initial closed cooling cycle.

Figure 6:
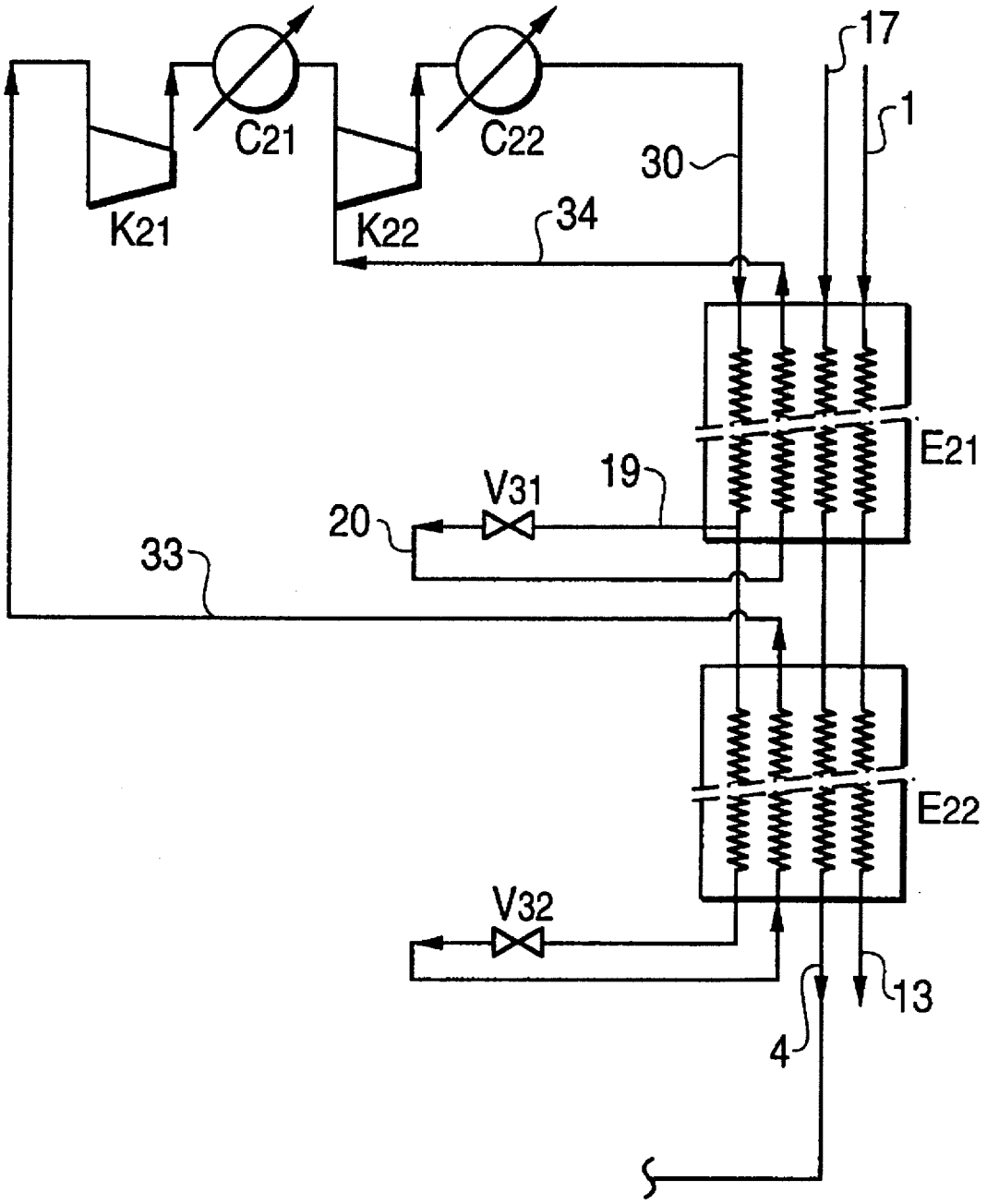

FIG. 6 illustrates a process based on this operating principle using a mixture of coolants, made up of ethane, propane and butane, for example, to carry out an additional cooling process for at least some of the mixture from the compression step and a first cooling step for the pressurised natural gas.

The first cooling cycle incorporates, for example, compressors $K_{21}$, $K_{22}$, condensers assigned to the compressors, respectively $C_{21}$ and $C_{22}$, and two exchangers $E_{21}$, $E_{22}$.

The cycle operates in the following manner, for example: the cooling mixture leaves the compressor $K_{22}$ at a pressure of 2 MPa, for example, and is then cooled in the condenser $C_{22}$ by a process of heat exchange with an external cooling fluid, for example. The cooled liquid fraction leaving the condenser $C_{22}$ is delivered via a pipe 30 to a first exchanger $E_{21}$ where it is put through a first step of undercooling. At least some of the cooled liquid fraction is fed out of the exchanger $E_{21}$ via a pipe 19 and expanded through the expansion valve $V_{32}$ before being recycled back to the exchanger $E_{21}$. It is evaporated at an intermediate pressure level preferably between the low pressure and the high pressure of the first cooling cycle. The vapour fraction generated during evaporation is discharged and recycled via a pipe 34, preferably located in the upper portion of the exchanger $E_{21}$, to the input of the compressor $K_{22}$. The remaining liquid fraction is delivered to a second exchanger $E_{22}$ via a pipe 31, where it undergoes a second stage of cooling. From there it is expanded through the expansion valve $V_{32}$ and then evaporated at a value essentially equal to the low pressure value of the first cooling cycle in the region of 0.15 MPa. The vapour fraction obtained during evaporation is fed via a pipe 33 to a compressor $K_{21}$ located upstream of the compressor $K_{22}$. At the output of compressor $K_{21}$, the vapour fraction is cooled in the condenser $C_{21}$ using an available external cooling fluid, for example, and then mixed with the vapour fraction fed from the exchanger $E_{22}$ via the pipe 34 before being sent to the compressor $K_{22}$.

This method makes use of the undercooled liquid fractions produced by evaporation in the respective exchanger $E_{21}$ and $E_{22}$ to carry out a first stage of cooling or additional stage of cooling for the vapour fractions from the separator chamber $S_3$ and/or for the pressurised natural gas to be liquefied as it passes through the exchanger $E_{21}$ via pipe 1 before being sent into the final exchanger, where the final liquefaction operation $E_1$ takes place (FIG. 2).

The cooling mixture arriving in vapour phase from the compression step is thus pre-cooled in two stages and is in a partially condensed form before it is fed via pipe 4 into the separator $S_1$ to be processed as described above, with reference to FIG. 2 for example.

Figure 7:
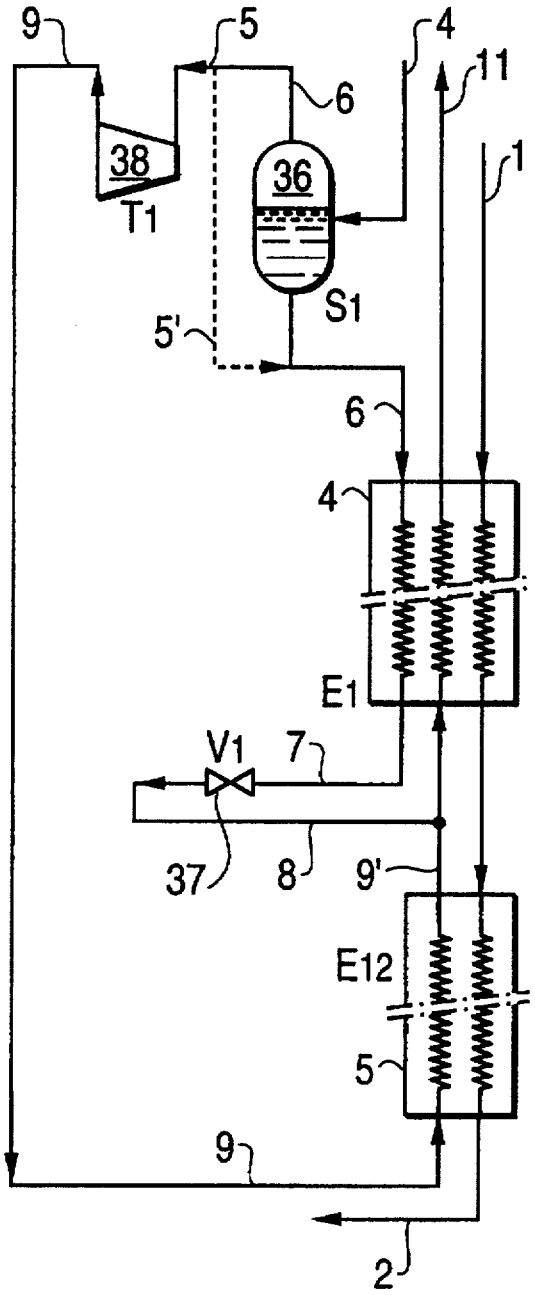
FIGS. 7 and 8 illustrate embodiments in which the expanded vapour fraction is cooled before being mixed with the expanded liquid fraction.

In accordance with another embodiment, illustrated in FIG. 7, the fluids M1 and M2 obtained by the process described in relation to FIG. 2 are not mixed directly after expansion.

The mixture M1 can be used, for example, to cool the natural gas, by a process of heat exchange, for example, before being mixed with the mixture M2. The device of FIG. 7 differs from the embodiment illustrated in FIG. 2 by dint of an additional exchanger $E_{12}$, preferably located directly after the exchanger $E_1$, the specific function of which is to cool the mixture M2.

The process is as follows, for example: the mixture M1 from the turbine $T_1$ is fed via the pipe 9 to the exchanger $E_{12}$ where it cools the natural gas fed from the exchanger $E_1$ via pipe 2. The mixture M1 leaves the exchanger $E_{12}$ via pipe 9' and is mixed with the mixture M2 leaving the exchanger $E_1$ via pipe 7, expanded through the expansion valve $V_1$ and returned to the exchanger $E_1$ via pipe 8 to produce the low-temperature mixture used to cool the natural gas delivered to the exchanger $E_1$ via pipe 1 and to undercool the liquid fraction delivered $_1$ to the exchanger $E_1$ from the separator $S_1$ via pipe 6. After heat exchange, this mixture leaves the exchanger $E_1$ via pipe 11 in exactly the same way as described in connection with FIG. 2, possibly to be recycled to the compressor $K_1$.

A proportion of the vapour phase from the separator $S_1$ may be fed via pipe 5' into the exchanger $E_1$. In the system illustrated in FIG. 7, it is mixed with the liquid phase from the separator $S_1$. It can also be delivered to the exchanger $E_1$ via an independent circuit in order to produce a liquid fraction that can then be undercooled, expanded, mixed with the mixture M1 from the turbine $T_1$ and fed with the mixture M1 into the exchanger $E_{12}$.

The cooling mixture used in this embodiment contains, for example, hydrocarbons whose number of atoms is preferably between 1 and 5, such as methane, ethane, propane, standard butane, isobutane, standard pentane or isopentane. It preferably contains at least 10% of nitrogen by molar fraction. These conditions can be met by restricting the content of heavy constituents in the vapour fraction, for example, and by controlling the temperature and pressure conditions at the turbine input.

The pressure of the cooling mixture is preferably at least 200 kPa at the input of the first compression stage $K_1$.

The liquid fraction is cooled, for example, to a temperature substantially close to the temperature obtained by the mixture of the two expanded fractions. Since this liquid fraction is undercooled preferably to a temperature lower than its evaporation temperature at the low pressure level of the cycle, it will not evaporate when expanded through the valve, which makes it possible to limit any mechanical phenomena that might be irreversible and improve performance of the cycle.

Advantageously, the fluids M1 and M2 can be mixed at different temperature levels, corresponding to successive stages of heat exchange with the cooled natural gas.

An example of the method of the invention is described with reference to FIG. 8, in which two successive fractions produced by expansion of the liquid fraction are mixed with the fraction produced by expanding the vapour fraction in two steps.

The exchanger $E_1$ of FIG. 2 is replaced by two successive exchangers $E_{13}$ and $E_{14}$.

The process is as follows, for example: the mixture M1 from the turbine $T_1$ is delivered through pipe 9 for mixing with a first fraction produced by expanding through valve $V_7$ the undercooled liquid fraction from the exchanger $E_{14}$, and is then fed to the exchanger $E_{14}$ where it is used to cool, for example, the natural gas from an exchanger $E_{13}$ located upstream, discharged via pipe 2 after cooling, then mixed with a second fraction produced by expanding the liquid fraction, taken from the output of the exchanger $E_{13}$ and expanded through valve $V_6$, and is then fed to the exchanger $E_{13}$.

Using this configuration means that the cooling power needed to cool the liquid fraction circulating in an exchanger can be reduced and performance of the cooling cycle improved.

In this embodiment, the vapour fraction from the cooling stage using external fluid goes through two successive stages of partial condensation by cooling under pressure, the vapour fractions produced from each of these stages being separated and fed to the subsequent stage, the vapour fraction produced from the last of these partial condensation stages being at least partially expanded in a turbine, with the option of recuperating at least partially a proportion of the mechanical expansion energy, then mixed with at least one of the liquid fractions, which has been expanded beforehand, thus producing a low-temperature mixture which is put through a process of heat exchange with the pressurised natural gas to be liquefied.

Figure 8:
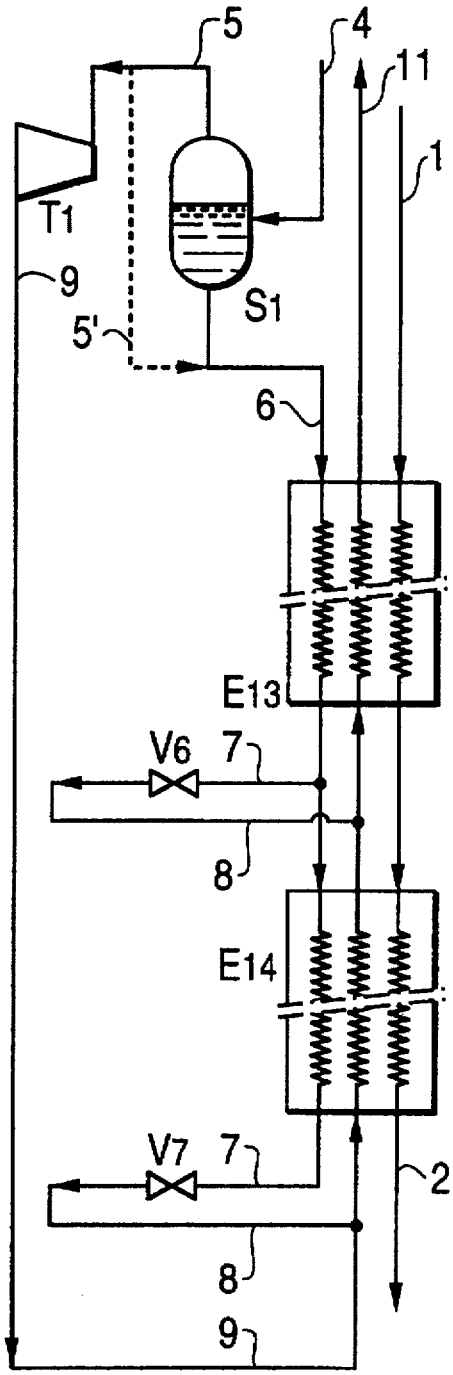

The embodiment illustrated in FIG. 8 show the use of two successive mixing stages between the expanded fractions, which can be extended to a greater number of stages without difficulty. The choice of the number of stages used will depend on considerations of economic optimisation.

Figure 9:
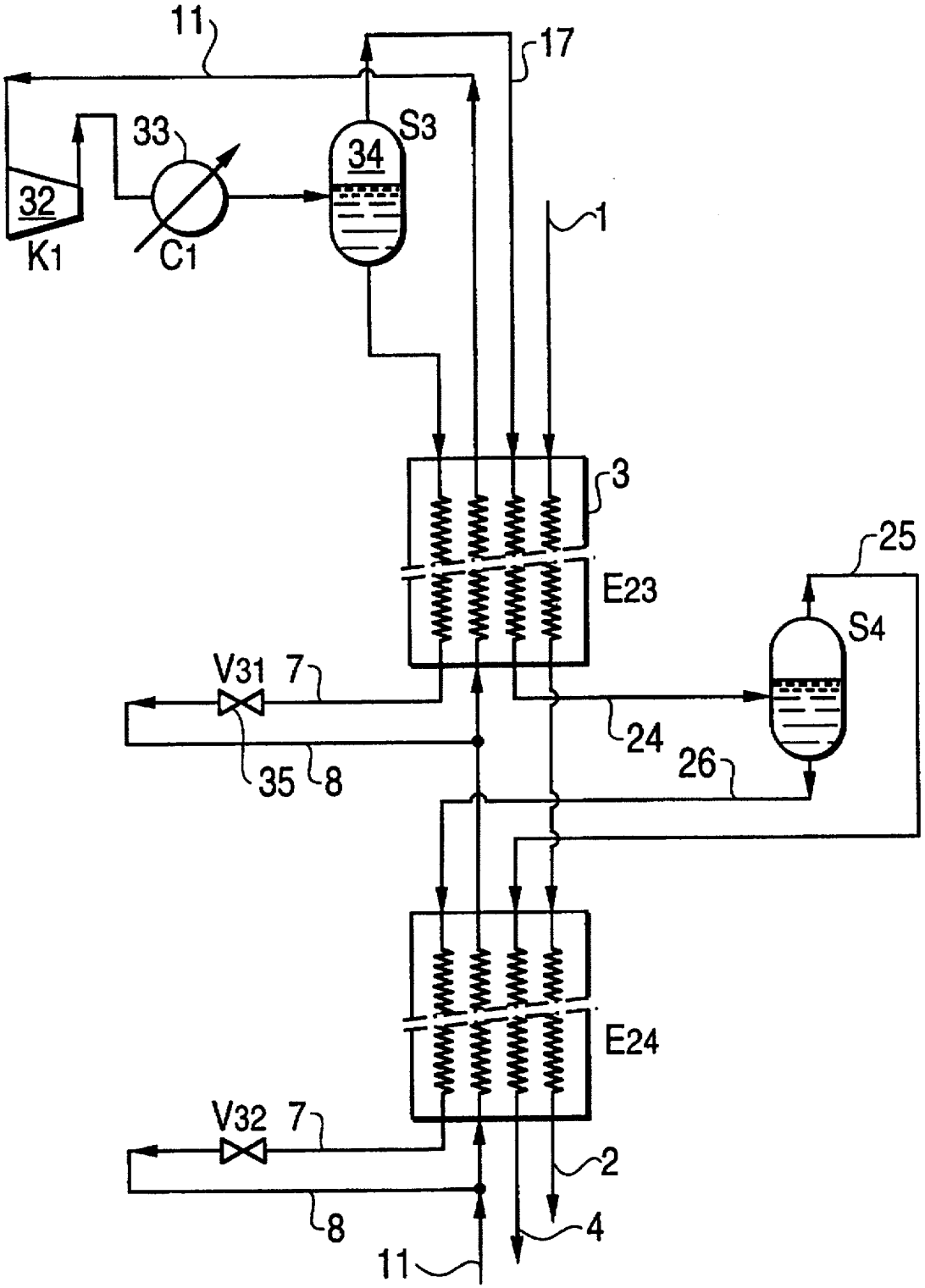
FIG. 9 shows an example of an embodiment in which the vapour fraction is partially condensed over several steps.

FIG. 9 illustrates another approach in which the vapour fraction produced by the process of cooling the cooling mixture in the condenser $C_1$ can be condensed over several steps before being fed into the separator $S_1$. In this case, it is preferable to separate the liquid fraction obtained after each step.

The device incorporates for example two condensation exchangers $E_{23}$ and $E_{24}$ linked to each other.

It operates in the following way, for example: the cooling mixture passes from the condenser $C_1$ to the separator $S_3$. At the output of the separator, the vapour fraction is fed via pipe 17 to the exchanger $E_{23}$ from which it is discharged, partially condensed, via a pipe 24 and the mixture obtained from the condensation process is separated by a separator chamber $S_4$. The vapour fraction is withdrawn from the separator chamber via a pipe 25, preferably located at the head of the chamber, and delivered to the exchanger $E_{24}$ in which it undergoes another process of partial condensation before being discharged in a state of liquid-vapour mixture via pipe 4 to the process steps described in connection with FIG. 2.

The liquid fraction fed from the separator $S_4$ via a pipe 26 is undercooled in the exchanger $E_{24}$, expanded in a valve $V_{32}$ to a pressure of about 200 kPa and mixed with the vapour fraction recycled from the exchanger $E_1$ via pipe 11, this mixture providing the cooling capacity required in the exchanger $E_{24}$.

At the output of the exchanger $E_{24}$, it is mixed with the undercooled liquid fraction in the exchanger $E_{23}$ and expanded through the expansion valve $V_{31}$ to form a new mixture, providing the cooling capacity required in the exchanger $E_{23}$, before being recycled to the compressor $K_1$ via pipe 11.

The vapour fraction from the final partial condensation stage is fed through pipe 4 to the separator chamber before being processed in a manner identical to that described with reference to FIG. 2 to obtain the mixtures M1 and M2 making up the low-temperature cooling mixture for liquefying the natural gas.

In the case of natural gases containing hydrocarbons heavier than methane, and in particular hydrocarbons that are capable of forming a gas fraction of liquefied petroleum (propane, butane) and a light petrol fraction (hydrocarbons with at least five carbon atoms), these hydrocarbons can be at least partially separated by condensation and/or distillation at the end of a first stage of cooling the pressurised natural gas.

Similarly, if the natural gas contains nitrogen and/or helium, these constituents can be at least partially separated by evaporation and/or distillation, the evaporation thus giving rise to additional cooling of the cooled pressurised natural gas in liquid state.

Figure 10:
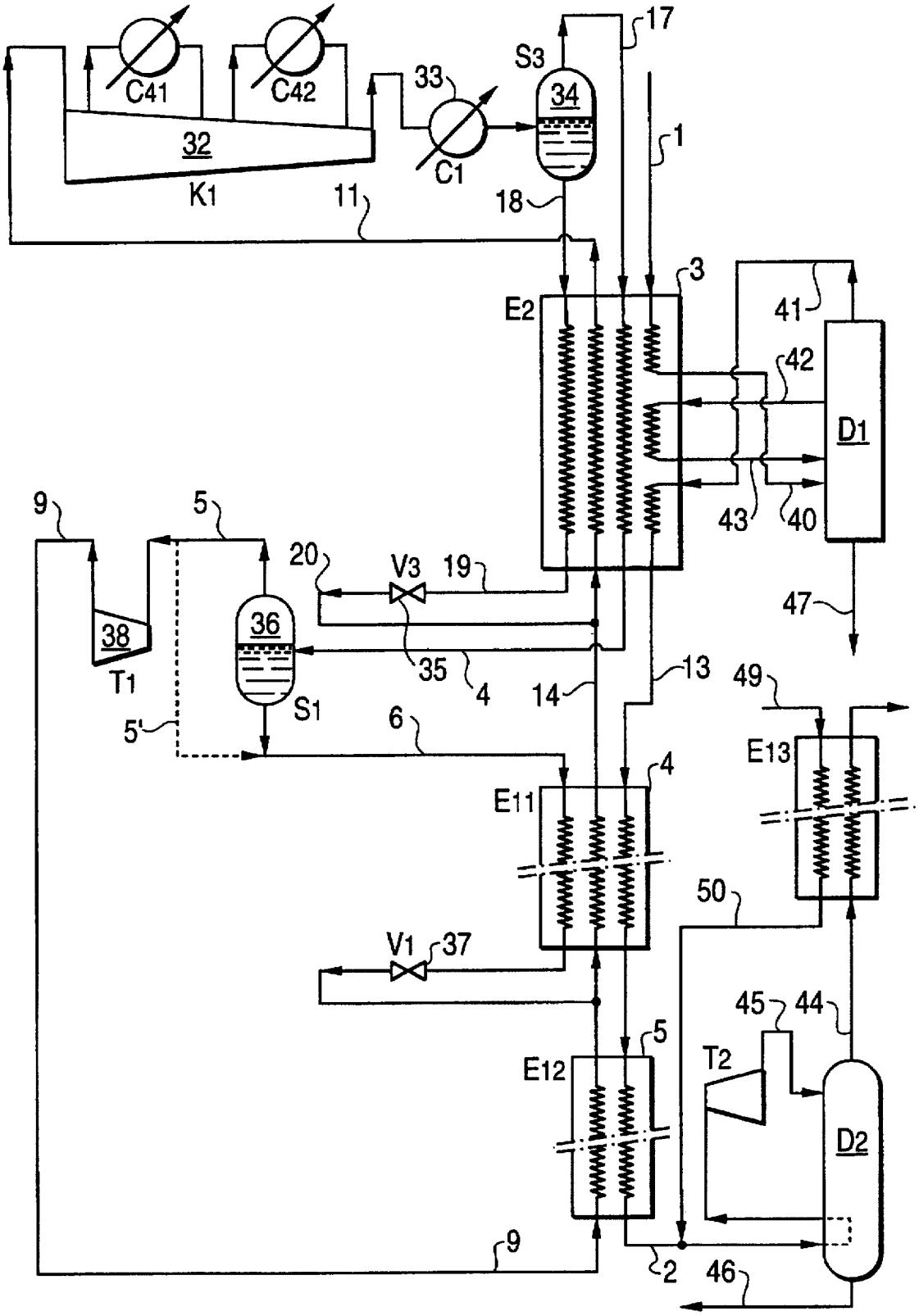
FIG. 10 illustrates how the method of the invention is implemented.

The following example accompanied by figures shows how it is possible to operate such an application. The example and accompanying figures are given with reference to FIG. 10, which corresponds in particular to implementation of the devices described in relation to FIGS. 4 and 7.

The natural gas, fed into the exchanger $E_2$ through pipe 1, is available at 6.5 MPa and contains, for example 88% mole of methane, 4% mole of nitrogen and hydrocarbons heavier than ethane, propane, butane, pentane and hexane. The partial separation of these heavy fractions can be performed during pre-cooling of the natural gas in the exchanger $E_2$. The natural gas cooled in the exchanger $E_2$ to −20° C. is delivered through pipe 40 to a distillation device $D_1$ comprising a column in which reflux is provided by a liquid fraction arriving through pipe 43. The natural gas rectified in the column in this way is delivered via pipe 41 to the exchanger $E_2$ where the cooling process is continued until it reaches −80° C.

After this first cooling stage in the exchanger $E_2$, the natural gas is cooled successively in the two exchangers $E_{11}$ and $E_{12}$ to a temperature of −148° C., for example. The final cooling of the natural gas is done by the distillation device of a column $D_2$ located downstream of the exchanger $E_{12}$ and it is expanded to a pressure of 0.13 MPa, for example, by the turbine $T_2$. At the output of this turbine $T_2$, the liquefied natural gas containing about 6% of vapour is fed into the head of column $D_2$ and then discharged from the base of the column $D_2$ via a pipe 46 at a temperature of essentially −160° C. The light fraction rich in nitrogen separated out in the column $D_2$ is discharged from the head of the column through pipe 44 and delivered to an exchanger $E_{13}$ where it is used to liquefy and undercool at least one fraction of the natural gas entering this exchanger via a pipe 49, for example, and discharged therefrom by a pipe 50 for mixing with the undercooled natural gas fraction delivered from the exchanger $E_{12}$ via pipe 2.

The cooling fluid used in this example is a mixture of nitrogen, methane, ethane, propane, standard butane and standard pentane, for example. The constituents in the highest proportions are nitrogen and methane, the molar content being 30% and 20% respectively. At the output of the compressor $K_1$, the cooling mixture is cooled to a temperature of 35° C. in the condenser $C_1$ and then sent to the separator chamber $S_3$, after which the vapour fraction reaches some 60% by mass, for example.

This vapour fraction is then partially condensed in the exchanger $E_2$.

The liquid fraction from the separator $S_3$ is undercooled in the exchanger $E_2$ and then expanded to a low pressure of 0.18 MPa, for example, in the valve $V_3$ and mixed with the light fraction of coolant fed from the exchanger $E_{11}$ via pipe 14. At the output of the exchanger $E_2$, the cooling mixture, in vapour phase, is fed via pipe 11 to the compressor $K_1$ which has intermediate cooling exchangers $C_{41}$ and $C_{42}$.

The vapour fraction partially condensed in exchanger $E_2$ is fed through pipe 4 into the chamber $S_1$ to produce a lighter vapour fraction which is delivered to the expansion turbine $T_1$ via pipe 5 and a heavier liquid fraction fed through pipe 6 for undercooling in the exchanger $E_{11}$. The temperature of chamber $S_1$ is −80° C., for example. The expansion process carried out in the turbine $T_1$ to 0.2 MPa, for example, allows this vapour fraction to be cooled to −150° C. at which point it contains 4% mole of liquid. The heavier liquid fraction undercooled in the exchanger $E_{11}$ is expanded in the valve $V_1$ and then mixed at low pressure and at a low temperature essentially equal to that of the vapour fraction from the turbine $T_1$. The temperature of the mixture thus obtained, before it is evaporated in counter-flow with the natural gas in the exchanger $E_{11}$, is such that a minimum thermal level of 2° C. can be maintained in this exchanger.

The processes of heat exchange taking place during the cooling stages are preferably carried out in counter-flow heat exchangers. These heat exchangers are, for example, multiple pass exchangers and are preferably configured as plate exchangers. These plate exchangers may be exchangers from brazed aluminium, for example. It is also possible to use stainless steel exchangers, in which the plates are welded to each other. The channels in which the fluids providing the heat exchange flow can be obtained by different means by arranging intermediate corrugated plates between the plates, using plates formed by explosion techniques, for example, or using plates etched by chemical engraving, for example.

Coil exchangers may also be used.

Various types of compressors can be used to compress the cooling mixture. The compressor may be of the centrifugal or axial type, for example. The cooling mixture is preferably compressed over at least two stages, between which a cooling stage is incorporated by means of heat exchange with the available external cooling fluid, water or air. By increasing the number of intermediate cooling steps, it is possible to reduce the compression power and improve performance of the cycle and the choice of this number of stages must be based on considerations of technical and economic optimisation.

The undercooled liquid fractions from the partial condensation of the mixture may be expanded, as shown in the examples described above, through expansion valves. It is also possible to expand at least one of the said fractions in a turbine and recuperate the mechanical expansion energy. In the case of example 1, each of the valves $V_1$ and $V_3$ can therefore be replaced by a turbine.

Similarly, the pressurised natural gas in undercooled liquid state may be expanded, as was shown in example 1, at least partially in a turbine to a pressure close to atmospheric pressure, producing the liquefied natural gas which is exported.

In all the examples of embodiments given here, the cooling mixture used for the cycle of liquefying a pressurised natural gas contains hydrocarbons whose number of atoms is preferably between 1 and 5, such as methane, ethane, propane, standard butane, isobutane, standard pentane, isopentane. It preferably contains a fraction of nitrogen lower than 10% by molar fraction.

Similarly, the temperature of the mixture obtained from the expanded liquid and vapour fractions is lower than the evaporation temperature of the liquid fraction under substantially identical pressure conditions.

The liquid fraction is preferably undercooled or additionally cooled to a temperature essentially identical to the temperature obtained by the mixture of the two expanded liquid and vapour fractions, which prevents it from evaporating when passed through the expansion valve, thus limiting any mechanical phenomena that might be irreversible and improving the performance of the cooling cycle.

A part of the vapour fraction may be cooled and condensed, the liquid fraction thus obtained being expanded and mixed with the fractions M1 and M2 to form the low-temperature mixture.

We claim:

1. Method of liquefying a pressurised natural gas in at least one cooling cycle using a mixture of cooling fluids, comprising the steps of:

at least partially condensing the cooling fluid mixture by compressing it and cooling it using an external cooling fluid, to obtain at least on vapour fraction and at least one liquid fraction, separating the at least one vapour fraction from the at least one liquid fraction in a separator;

separately expanding each of the vapour and liquid fractions in separate expansion devices to produce a light fluid M1 mainly consisting of a vapour phase and a heavy fluid M2 mainly consisting of a liquid phase, wherein at least a portion of the vapour fraction is fed directly from the separator to the expansion device and directly expanded after being separated from the liquid fraction, mixing at least some of the fluids M1 and M2 to obtain a low-temperature mixture, and liquefying and undercooling the pressurised natural gas by a process of heat exchange with the low-temperature mixture.

2. Method of liquefying a natural gas as claimed in claim 1, wherein the vapour fraction is expanded using a turbine and at least a proportion of the mechanical expansion energy is recuperated.

3. Method of liquefying a natural gas as claimed in claim 1, wherein the cooling mixture produced as a result of the thermal exchange with the natural gas is recycled to the step of at least partially condensing the cooling fluid mixture.

4. Liquefaction method as claimed in claim 1, further comprising cooling the fluid M2 before it is mixed with the fluid M1.

5. Liquefaction method as claimed in claim 1, further comprising at least one additional step of cooling the cooling mixture and/or a liquid fraction and/or a vapour fraction produced by the partial condensation of this mixture and/or the natural gas is carried out.

6. Method as claimed in claim 1, wherein the cooling fluid mixture comprises nitrogen and hydrocarbons having a number of carbon atoms ranging between 1 sand 5, the cooling fluid mixture containing at least 10% of nitrogen by molar fraction.

7. Method of liquefying a natural gas as claimed in claim 1, wherein the cooling fluid mixture has a pressure level equal to at least 200 kPa at compressor suction during the step of at least partially condensing the cooling fluid mixture.

8. Method of liquefying a natural gas as claimed in claim 1, wherein the fluid M1 contains less than 10% of liquid fraction by molar fraction.

9. Liquefaction method as claimed in claim 1, wherein the natural gas contains constituents comprising hydrocarbons other than methane and/or nitrogen and/or helium, and wherein the method further comprises separating at least some of the constituents from the natural gas by evaporation and/or distillation.

10. Liquefaction method as claimed in claim 1, further comprising expanding the pressurised natural gas in the undercooled liquid state at least partially in a turbine to a pressure close to atmospheric pressure, producing the liquefied natural gas that is then exported.

11. Installation for cooling a fluid, particularly for liquefying a natural gas, using a cooling mixture, comprising a first device for at least partially condensing the cooling mixture, having at least one compressor ($K_1$) operably connected to at least one condenser ($C_1$), a separator ($S_1$) operably connected to an output of the first device for separating a vapour fraction and a liquid fraction resulting from partial condensation in the first device, a first expansion device ($T_1$) directly connected to a vapour fraction output of the separator ($S_1$) for directly expanding at least a portion of the vapour fraction, a second expansion device ($V_1$) operably connected to a liquid fraction output of the separator ($S_1$) for expanding the liquid fraction, wherein outputs of the first ($T_1$) and second ($V_1$) expansion devices are operably connected to provide a mixture of expanded vapour and liquid fractions, and at least one device ($E_1$) in which the mixture of expanded liquid and vapour fractions is brought into thermal contact with the fluid to be cooled.

12. Installation as claimed in claim 11, the first expansion device ($T_1$) and/or the second expansion device ($V_1$) is a turbine.

13. Installation as claimed in claim 11, further comprising an additional device for cooling the expanded liquid and/or vapour fractions, the natural gas or the cooling mixture.

* * * * *